US005566927A

United States Patent [19]

Venegas, Jr.

[11] Patent Number: 5,566,927

[45] Date of Patent: Oct. 22, 1996

[54] GUARD RAIL ASSEMBLY

[76] Inventor: Frank Venegas, Jr., 4165 Homestead, Howell, Mich. 48843

[21] Appl. No.: 368,645

[22] Filed: Jan. 4, 1995

[51] Int. Cl.[6] ..... E04H 17/14

[52] U.S. Cl. ..... 256/59; 256/19; 256/65; 256/73; 49/396

[58] Field of Search ..... 256/19, 73, 25, 256/26, 13.1, 65, 67, 59, 1; 49/381, 396; 160/135, 351; 404/6; 119/20, 840

[56] References Cited

U.S. PATENT DOCUMENTS

| | | | |
|---|---|---|---|
| 1,200,879 | 10/1916 | Harrison | 49/396 X |
| 3,336,908 | 8/1967 | Swanson | 119/20 X |
| 3,533,189 | 10/1990 | Appell et al. | 49/396 |
| 3,565,152 | 2/1971 | Cohn, Jr. et al. | 160/351 X |
| 3,921,585 | 11/1975 | Hall | 119/20 |
| 4,461,461 | 7/1984 | Caron | 256/19 |
| 4,727,702 | 3/1988 | Baker et al. | 49/381 X |
| 4,892,292 | 1/1990 | Russell | 256/19 X |
| 4,951,925 | 8/1990 | Schultz et al. | 256/65 |
| 5,170,996 | 12/1992 | Venegas, Jr. et al. | 256/65 X |
| 5,261,647 | 11/1993 | Venegas, Jr. et al. | 256/19 X |

FOREIGN PATENT DOCUMENTS

| | | | |
|---|---|---|---|
| 2238331 | 5/1991 | United Kingdom | 256/65 |

*Primary Examiner*—Kenneth J. Dorner
*Assistant Examiner*—Harry C. Kim
*Attorney, Agent, or Firm*—Gifford, Krass, Groh, Sprinkle, Patmore, Anderson & Citkowski, P.C.

[57] ABSTRACT

A guard rail assembly having a vertical support stanchion and a horizontal rail. The rail and stanchion have polymerized sheathing extending about the stanchion and rail to protect the assembly from the environment. The guard rail assembly may also include a seal interposed of the polymerized sheathing to further protect the assembly from the environment. The guard rail assembly may also be pivotable about a vertical rail to allow access to the guarded area.

10 Claims, 1 Drawing Sheet

F
10
18
32
30
3
46
34
14
36
43
12
42
24
35
28
20
26
38
16
22
44
55
40
53
58
49
4
51
48
47
54
56
52
50

GUARD RAIL ASSEMBLY

BACKGROUND OF THE INVENTION

I. Field of the Invention

The present invention relates to a guard rail assembly. More particularly, the present invention relates to a guard rail assembly having a polymerized sheath extending about the rails of the assembly and further including a gasket or seal seated between the polymerized sheathing to prevent foreign objects such as food or metal shavings from collecting between the polymerized sheaths. The guard rail assembly of the present invention may also be used as a gate pivotable about itself to allow access to the guarded area.

II. Description of the Relevant Art

Typically, guard rail assemblies are often formed of metal bars having horizontal and vertical rails permanently affixed to each other to create a guard rail. A disadvantage of these previously known structures is that the metal rail may rust from being exposed to the environment. A further disadvantage of a metal rail is that any damage done to the rail, such as bending or puncturing the rod by a collision with a vehicle, for instance, will cause irreparable damage to the guard rail assembly. The whole assembly must then be replaced or repainted to prevent the metal from rusting.

A still further disadvantage of these previously known guard rail assemblies is that the assembly is not antiseptic and may accumulate bacteria and germs from the environment. As such these guard rail assemblies are generally unsafe for use in a factory handling food or food stuffs for human consumption.

A still further disadvantage of these previously known guard rail assemblies is that once assembled the guard rail is a permanent fixture. Therefore, the guard rail does not permit access to the interior area that is being guarded.

SUMMARY OF THE PRESENT INVENTION

The present invention provides a guard rail assembly which overcomes the disadvantages of the previously known guard rail assemblies.

The guard rail assembly of the present invention is formed of a vertical support stanchion and a horizontal rail having a polymerized sheath, preferably formed of plastic, extending about the stanchion and the rail. The polymerized sheath protects the metal stanchion and rail from the environment, thereby, eliminating the need to repaint or replace the guard rail assembly due to rust or other damage.

The guard rail assembly of the present invention may also be provided with a seal or gasket interposed of the polymerized sheaths. The seals prevent any foreign objects from collecting at the junction between the vertical and horizontal sheaths. The polymerized sheaths in combination with the seals create a clean environment, free of bacteria or dirt, about the guard rail assembly.

The guard rail assembly of the present invention also provides for access to the inner area being guarded. The guard rail assembly of the present invention does so by being pivotable about a vertical support stanchion. Thus, the guard rail assembly acts as a pivoting gate that may be locked in an opened or closed position.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

Figures 1, 2, 3, 4, 5:
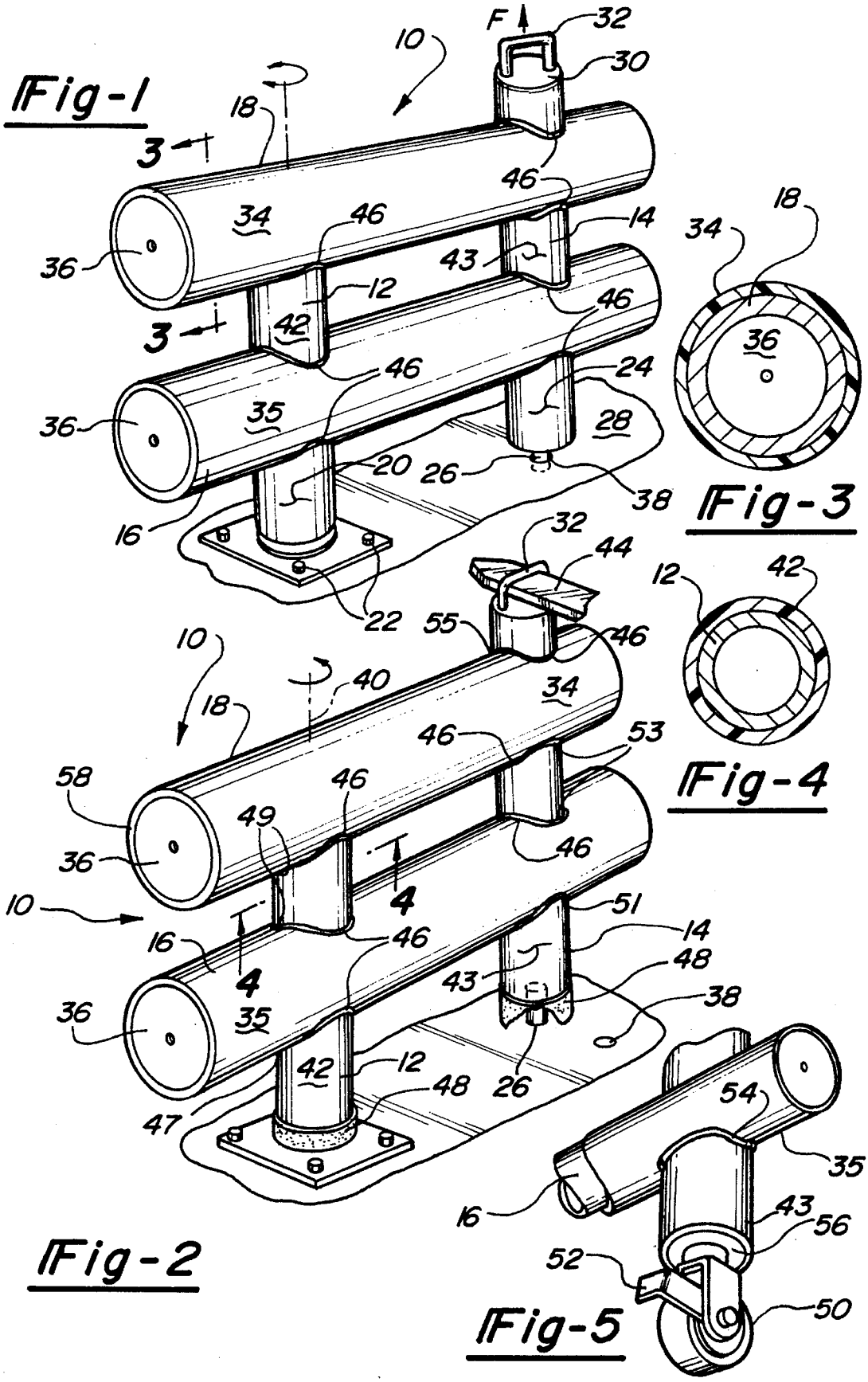
FIG. 1 is a perspective view illustrating a preferred embodiment of the present invention in a closed position.
FIG. 2 is a perspective view illustrating a preferred embodiment of the present invention in an open position.
FIG. 3 is a cross-sectional view of FIG. 1.
FIG. 4 is a cross-sectional view of FIG. 2.
FIG. 5 is a partial perspective view illustrating a second preferred embodiment of the present invention.

With reference first to FIG. 1, a first preferred embodiment of the guard rail assembly 10 of the present invention is thereshown in a closed position.

The guard rail assembly 10 is preferably formed of a vertical support stanchion 12 and a second vertical support stanchion 14. A lower horizontal rail 16 and an upper horizontal rail 18 extend perpendicular to the vertical support stanchions 12, 14.

One of the vertical support stanchions 12 is affixed in a stationary position at base 20 by any means such as bolts 22. The stanchion 12 is affixed to any type of flooring 28.

Second vertical stanchion 14 is provided at its base 24 with a pin 26 extending from below the base 24. Pin 26 extends into opening 38, as shown in FIG. 2, and provided in flooring 28.

Bar 30 extends from pin 26 through vertical support stanchion 14 and above upper horizontal rail 18. Pin 26 is fixedly attached to bar 30 at one end and handle 32 is fixedly attached to bar 30 at the opposite end.

With reference to FIGS. 1, 2 and 3, polymerized sheath 34 is thereshown extending about upper horizontal rail 18. A polymerized sheath 35 similarly extends about lower horizontal rail 16.

With reference to FIGS. 1, 2 and 4, polymerized sheath 42 extends about vertical support stanchion 12. Similarly, polymerized sheath 43 also extends about vertical support stanchion 14. Polymerized sheaths 42, 43 are separated at junctions 47, 49, 51, 53 and 54 respectively to allow for assemblage and disengagement of the guard rail assembly 10.

With reference now to FIG. 2, showing the preferred embodiment in an open position, the guard rail assembly 10 is pivoted about pivot point 40. To perform this rotation, handle 32 is provided with enough area to support a projecting prong 44 of a forklift. Any other object, including human force, may be applied to handle 32 to lift the handle upward as described by the arrow F in FIG. 1. Moving handle 32 upward moves pin 26 upward and out of opening 38. Fork prong 44 can then be used to rotate vertical support stanchion 14 about pivot point 40 and create an opening access to the guarded area. Handle 32 may be formed to accommodate any type of machinery or the human hand which may be used to lift and rotate the guard rail assembly 10.

With reference now to FIGS. 1 and 2, guard rail assembly 10 is thereshown having seals 46, such as gaskets, interposed of vertical polymerized sheathing 42, 43 and horizontal polymerized sheathing 34, 35. Like the polymerized sheathing, the gaskets are easily removable and replaceable. Thus, the gasket and polymerized sheathing provide a sealed unit allowing the guard rail assembly to be used in areas requiring an antiseptic area such as a food packing factory.

With reference to FIG. 2, seals 48 are provided at the base 20, 24 of vertical support stanchions 12, 14. Seals 48 accommodate the rotation of the vertical support stanchions 12 and 14 about pivot point 40.

With reference now to FIG. 5, a partial perspective view is thereshown illustrating a second preferred embodiment of the present invention. In the second preferred embodiment, a wheel 50 is provided opposite handle 32. A locking mechanism 52, such as a sheave, is fixedly attached to the wheel assembly and locks the wheel in position. Like the first preferred embodiment, the guard rail assembly 10 shown in FIG. 5 may be rotated from an open position to a closed position by engaging handle 32 with any means, releasing sheave 52 from a locked position on wheel 50 and rotating the guard rail assembly 10 about pivot point 40 as shown in FIGS. 1 and 2. When the assembly 10 is moved to its preferred position, sheave 52 is replaced in a locked position about wheel 50.

Similarly, if the gate assembly of FIG. 5 is preferably to be used in an antiseptic environment, seals 54 may be provided between polymerized sheaths 34, 35 and 42, 43. Wheel 50 may be set within an opening 38 of the flooring 28. Further, a seal 56 maybe provided between the sheath 43 and wheel assembly.

Finally, with reference to FIGS. 1 through 3, end cap 36 formed of polymerized material may be provided at the exposed ends of each horizontal rail 16, 18. A seal 58 may also be provided between each of the end caps 36 and polymerized sheathing 34, 35 to provide an even more antiseptic area.

Having described my invention, however, many modifications thereto will become apparent to those skilled in the art to which it pertains without deviation from the spirit of the invention as defined by the scope of the appended claims.

I claim:

1. A knock down gate assembly comprising:

two spaced apart vertical support stanchions a horizontal rail supported by said vertical stanchions;

a polymerized sheath extending the length of each of said vertical support stanchions;

a polymerized sheath extending the length of said horizontal rail; and a seal removably seated between each of said vertical support stanchions and said horizontal rail;

means for rotating said gate about one of said two vertical support stanchions comprising:

another of said two vertical support stanchions comprising a bar disposed within said stanchion and extending above said horizontal rail and also extending through at least the length of said stanchion for securing said gate assembly in place;

said bar comprising a handle means for receiving a forklift prong at one end extending above said horizontal rail.

2. The knock down gate assembly defined in claim 1 and further comprising a polymerized sheath extending the length of said bar extending above the horizontal rail.

3. The knock down gate assembly defined in claim 2 and further comprising a seal between said horizontal polymerized sheath and said polymerized sheath of said bar.

4. The knock down gate assembly defined in claim 1 and further comprising seals between each of said vertical polymerized sheathing and the ground.

5. The knock down gate assembly defined in claim 1 wherein said rotating means further comprises a pin extending from said bar opposite said handle means for seating within a hole within the ground, said hole having a diameter equal to said pin.

6. The knock down gate assembly as defined in claim 5 wherein a seal is provided between said pin and said other stanchion.

7. The knock down gate assembly defined in claim 1 wherein said rotating means further comprises a lock and wheel mechanism extending from said bar opposite said handle means.

8. A knock down gate assembly defined in claim 7 wherein a seal is provided between said lock and wheel mechanism and said other stanchion.

9. The knock down gate assembly defined in claim 1, wherein said horizontal rail is hollow and further comprise end cap formed of polymerized sheathing.

10. The knock down gate assembly defined in claim 9 and further comprising a seal between said end cap and said horizontal rail.

* * * * *

UNITED STATES PATENT AND TRADEMARK OFFICE

CERTIFICATE OF CORRECTION

PATENT NO. : 5,566,927

DATED : October 22, 1996

INVENTOR(S) : Frank Venegas, Jr.

It is certified that error appears in the above-indentified patent and that said Letters Patent is hereby corrected as shown below:

Column 2, line 51, "54" should be --55--.

Signed and Sealed this

Thirteenth Day of May, 1997

Bruce Lehman

*Attest:*

BRUCE LEHMAN

*Attesting Officer*

*Commissioner of Patents and Trademarks*